US010843852B2

(12) United States Patent
Reinhart et al.

(10) Patent No.: US 10,843,852 B2
(45) Date of Patent: Nov. 24, 2020

(54) LID WITH PYLONS FOR SUPPORTING CROSS BEAMS

(71) Applicant: Creative Plastic Concepts, LLC, Sycamore, OH (US)

(72) Inventors: Nickolas Reinhart, Findlay, OH (US); Jacob H. Whitta, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 75 days.

(21) Appl. No.: 15/989,941

(22) Filed: May 25, 2018

(65) Prior Publication Data

US 2018/0339820 A1 Nov. 29, 2018

Related U.S. Application Data

(60) Provisional application No. 62/510,815, filed on May 25, 2017.

(51) Int. Cl.

| | |
|---|---|
| ***B65D 51/24*** | (2006.01) |
| ***B65D 21/02*** | (2006.01) |
| ***B65D 43/02*** | (2006.01) |
| ***B65D 81/36*** | (2006.01) |
| ***B65D 1/22*** | (2006.01) |

(52) U.S. Cl.

CPC ..... *B65D 51/24* (2013.01); *B65D 1/22* (2013.01); *B65D 21/0217* (2013.01); *B65D 43/0202* (2013.01); *B65D 43/0214* (2013.01); *B65D 81/36* (2013.01); *B65D 81/365* (2013.01); *B65D 2543/00027* (2013.01); *B65D 2543/00194* (2013.01); *B65D 2543/00296* (2013.01); *B65D 2543/00342* (2013.01); *B65D 2543/00351* (2013.01); *B65D 2543/00398* (2013.01); *B65D 2543/00555* (2013.01)

(58) Field of Classification Search

CPC .. B65D 51/24; B65D 43/0202; B65D 81/365; B65D 2543/00027; B65D 2543/00194; B65D 2543/00296; B65D 2543/00345

USPC ..... 220/212, 23.83, 521; 206/508, 509

See application file for complete search history.

(56) References Cited

U.S. PATENT DOCUMENTS

| | | | | |
|---|---|---|---|---|
| 3,117,692 | A | 1/1964 | Carpenter et al. | |
| 3,326,410 | A | 6/1967 | Asenbauer | |
| 4,832,200 | A * | 5/1989 | Deaton | B65D 21/0217 206/508 |

(Continued)

*Primary Examiner* — J. Gregory Pickett
*Assistant Examiner* — Niki E Eloshway
(74) *Attorney, Agent, or Firm* — Jacob M. Ward; Ward Law force LLC

(57) ABSTRACT

A lid for a container or tote has a main body with pylons. The pylons are arranged on the lid to provide a first pylon adjacent to a second pylon. The first and second pylons may each have a plurality of platforms that can support and stabilize a cross beam such as a board placed in between them. The platforms may include a first platform, a second platform, and a third platform. The first platform is horizontally spaced apart from the second platform, and the second platform is horizontally spaced apart from the third platform. The first platform is vertically spaced apart from the second platform, and the second platform is vertically spaced apart from the third platform. Corresponding ones of the platforms on the adjacent pylons may be disposed on a same plane so as to provide a planar or flat surface for receiving the cross beam.

19 Claims, 6 Drawing Sheets

(56) References Cited

U.S. PATENT DOCUMENTS

| | | | | |
|---|---|---|---|---|
| 5,186,330 | A * | 2/1993 | McClure | B62B 3/16 206/508 |
| 5,507,385 | A * | 4/1996 | Koloski | B25H 3/023 206/372 |
| 5,791,486 | A * | 8/1998 | Brahmbhatt | H01L 21/67333 206/509 |
| 6,371,364 | B1 * | 4/2002 | Maillot | B65D 5/20 206/508 |
| 6,868,970 | B2 * | 3/2005 | Gardiner | H05K 13/0084 206/509 |
| 8,360,265 | B1 * | 1/2013 | Andrews | B65D 25/00 220/659 |
| 9,828,162 | B2 * | 11/2017 | Bachman | B65D 81/361 |
| 10,384,844 | B2 * | 8/2019 | Phelan | B65D 21/0223 |
| 2006/0032785 | A1 * | 2/2006 | Liu | H01L 21/67369 206/710 |
| 2006/0070905 | A1 * | 4/2006 | Hampel | B65D 21/0223 206/403 |
| 2006/0254946 | A1 * | 11/2006 | Becklin | B65D 21/0223 206/508 |
| 2007/0256958 | A1 * | 11/2007 | Zhang | H01L 21/67333 206/725 |

* cited by examiner

LID WITH PYLONS FOR SUPPORTING CROSS BEAMS

CROSS REFERENCE TO RELATED APPLICATIONS

This application claims the benefit of U.S. Provisional Application Ser. No. 62/510,815, filed on May 25, 2017. The entire disclosure of the above application is hereby incorporated herein by reference.

FIELD

The present disclosure relates to a lid and, more particularly, to a lid for a storage container or tote.

BACKGROUND

The statements in this section merely provide background information related to the present disclosure and may not constitute prior art.

When working on a construction site, employees must bring their tools in one tote and use a sawhorse or other work surfaces during construction. The simultaneous use of a sawhorse and a tote can take up unnecessary space, making it cumbersome to work in smaller areas. Additionally, when tools are stored within the tote, it may be burdensome to retrieve them. This is especially the case when construction material is stacked on top of the lid of the tote.

Totes with lids are well known in the industry. For example, U.S. Pat. No. 3,117,692 to Carpenter et al. illustrates containers with lids which can be stacked to a substantial height and transported without danger of toppling. In another example, U.S. Pat. No. 3,326,410 to Asenbauer a stackable and nestable container having a length approximately equal to twice its width and having upwardly and outwardly sloping side and end walls. Identical containers of Asenbauer may not only be nested and conventionally stacked but also may be interlocked together in a multitude of stacked arrangements to form very stable stacked configurations. However, these known lids are not particularly suitable for supporting construction materials and implements.

There is a continuing need for a lid for a container that is suitable for supporting construction materials and implements. Desirably, the container lid can serve as an alternative to a sawhorse, as well as provide access to tools without requiring removal of the lid from the container.

SUMMARY

In concordance with the instant disclosure, a lid for a container that is suitable for supporting construction materials and implements, and which can serve as an alternative to a sawhorse, as well as provide access to tools without requiring removal of the lid from the container, has been surprisingly discovered.

In one embodiment, the lid has a main body with an upper surface, pylons and a lip surrounding the main body. The upper surface is vertically and horizontally spaced apart from the lip of the lid. The pylons are located along the perimeter of the upper surface. The pylons are oriented to have a first pylon adjacent to, but spaced apart from, a second pylon. The first and second pylons may each have a plurality of platforms that are configured to receive, support and stabilize a cross beam placed in between them. The plurality of platforms may include a first platform, a second platform, and a third platform, arranged in a step-like configuration. The first platform is horizontally spaced apart from the second platform. The second platform is horizontally spaced apart from the third platform. The first platform is also vertically spaced apart from the second platform. The second platform is also vertically spaced apart from the third platform.

In another embodiment, the main body of the lid has at least one recess formed therein. The at least one recess is configured to hold particular tools. For example, the main body may have one recess that is configured to securely hold a level, and another recess that is configured to securely hold a tape measure. The recess configured to hold the level may also be surrounded by finger-sized indents. The indents allowing a user to easily remove the level from the recess. Furthermore, the recess holding the tape measure may have securement means configured to selectively fasten the tape measure to the lid. The main body of the lid may also have a plurality of rectangular recesses that are configured to hold instruments for easy access during construction.

In a further embodiment, the lid has a main body with a lip and an upper surface vertically and horizontally spaced apart from the lip. Further surrounding the upper surface is a plurality of pylons, each pylon having a first platform and a second platform. The first platform is horizontally and vertically spaced apart from the second platform, and the second platform is horizontally and vertically spaced apart from the upper surface.

In an additional embodiment, the lid has a main body with an upper surface that is vertically and horizontally spaced from the lip. Surrounding the outer perimeter of the upper surface is a plurality of pylons in the form of singular or unitary protrusions. Further formed in the upper surface is a recess. A distance between the upper surface and the lip is greater than a distance between the upper surface and a bottom of the recess. The lid is configured to be stacked upon another lid of the same constructions in either a nested or an unnested configuration, where the recesses are aligned in the nested configuration and are unaligned in the unnested configuration.

Further areas of applicability will become apparent from the description provided herein. It should be understood that the description and specific examples are intended for purposes of illustration only and are not intended to limit the scope of the present disclosure.

DRAWINGS

The above, as well as other advantages of the present invention, will become clear to those skilled in the art from the following detailed description of a preferred embodiment when considered in the light of the accompanying drawings in which.

Figure 6:
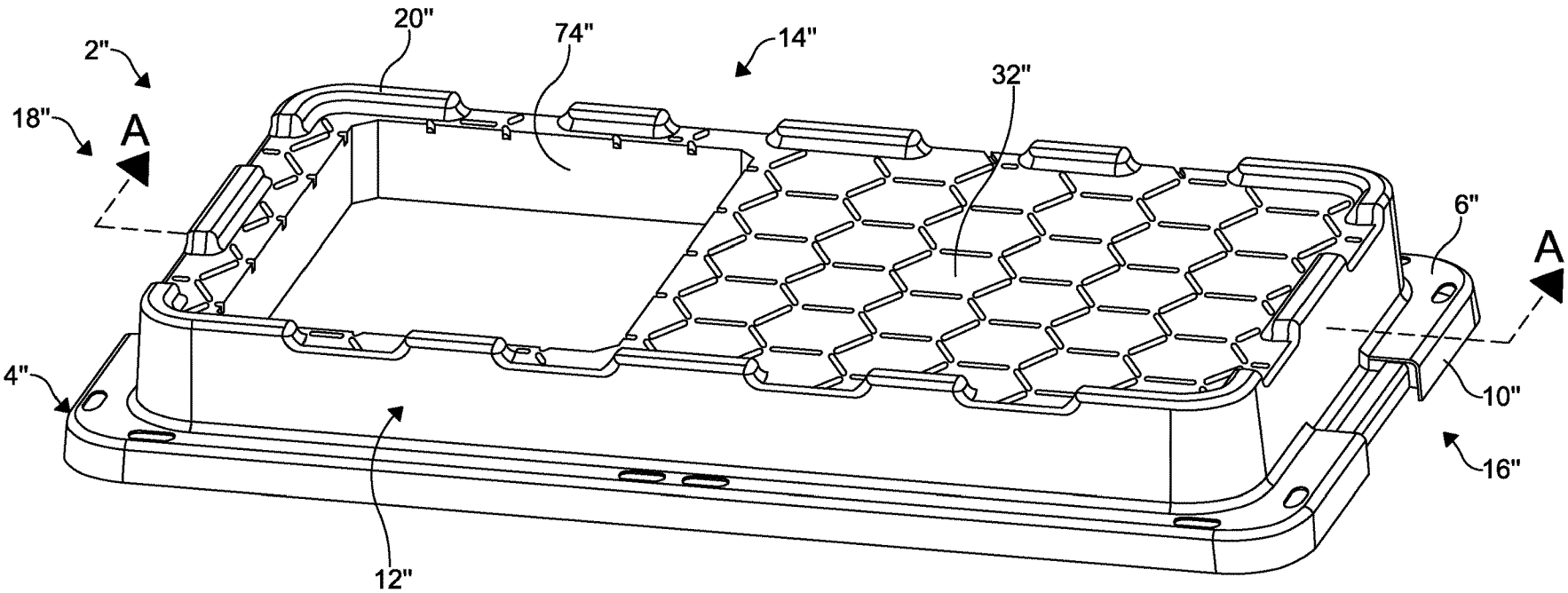
FIG. 6 is a top perspective view of a lid according to a further embodiment of the present disclosure.
Figure 7:
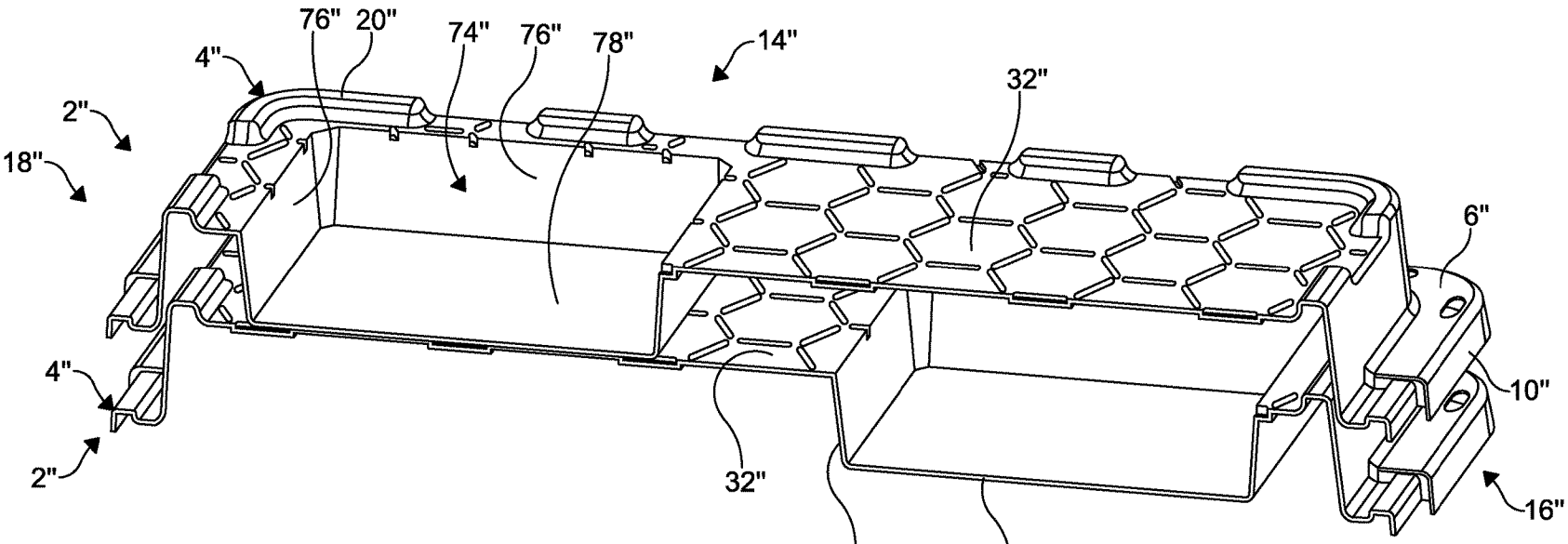
Figure 8:
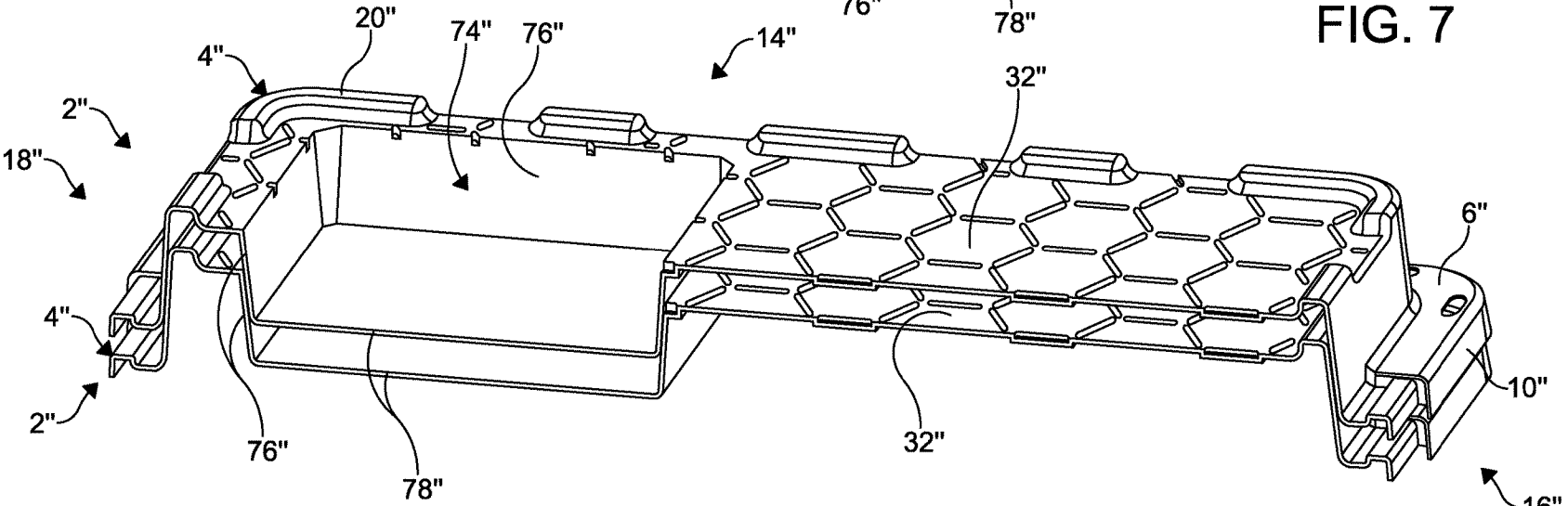

FIG. 7 is a cross-sectional top perspective view of a combination including a pair of the lids taken along section line A-A in FIG. 6, a top one of the lids stacked on a bottom one of the lids, where the recessed portions of the top and bottom lids are spaced apart from one another and are unnested; and FIG. 8 is a cross-sectional top perspective view of a combination including a pair of the lids taken long section line A-A in FIG. 6, a top one of the lids stacked on a bottom one of the lids, where the recessed portions of the top and bottom lids are aligned with one another and are nested.

DETAILED DESCRIPTION

The following description is merely exemplary in nature and is not intended to limit the present disclosure, application, or uses. Throughout the drawings, corresponding reference numerals indicate like or corresponding parts and features.

In the description, relative terms such as "lower," "upper," "horizontal," "vertical," "forward," "rearward," "above," "below," "up," "down," "top," "diagonal," and "bottom" as well as derivatives thereof (e.g., "horizontally," "downwardly," "upwardly," "diagonally," etc.) should be construed to refer to the orientation as then described or as shown in the related drawing. These relative terms are for convenience of description and do not require that the apparatus be constructed or operated in a particular orientation. Terms concerning attachments, such as "connected," "connecting," "coupled," and "coupling" are used interchangeably and refer to one structure or surface being secured to another structure or surface, unless expressly described otherwise.

Figure 1:
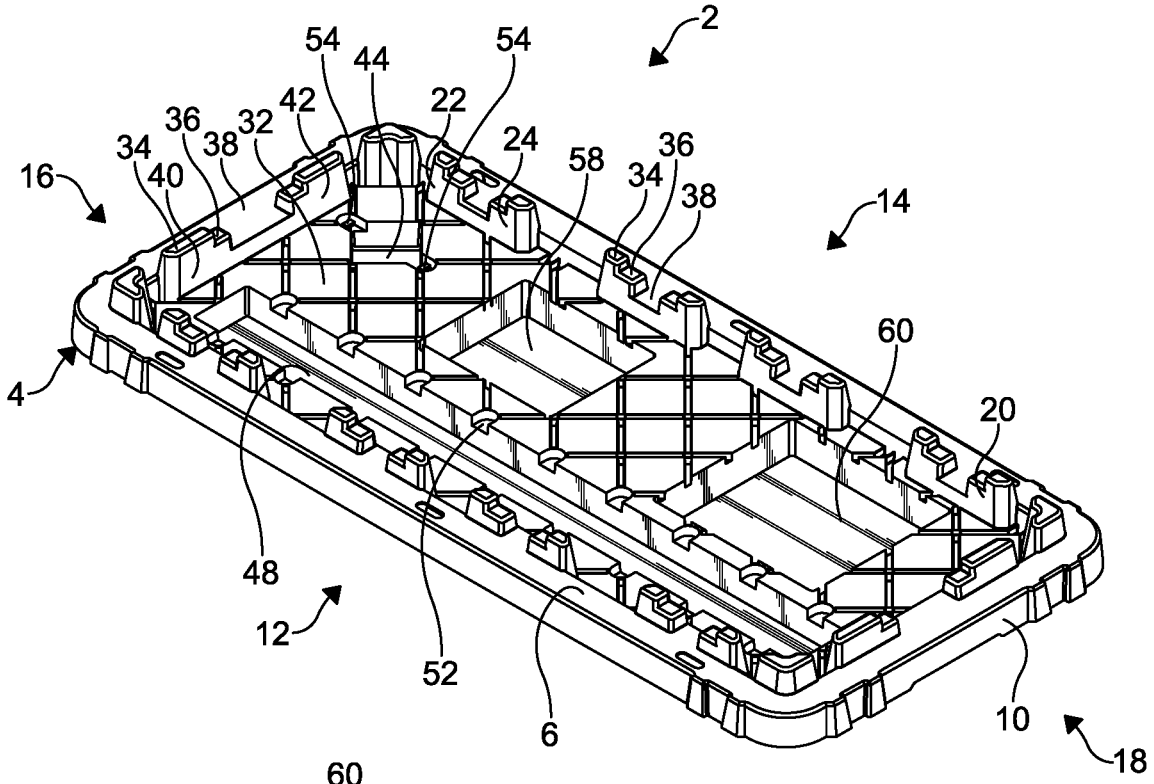
FIG. 1 is a top perspective view of a lid according to one embodiment of the present disclosure.
Figure 2:
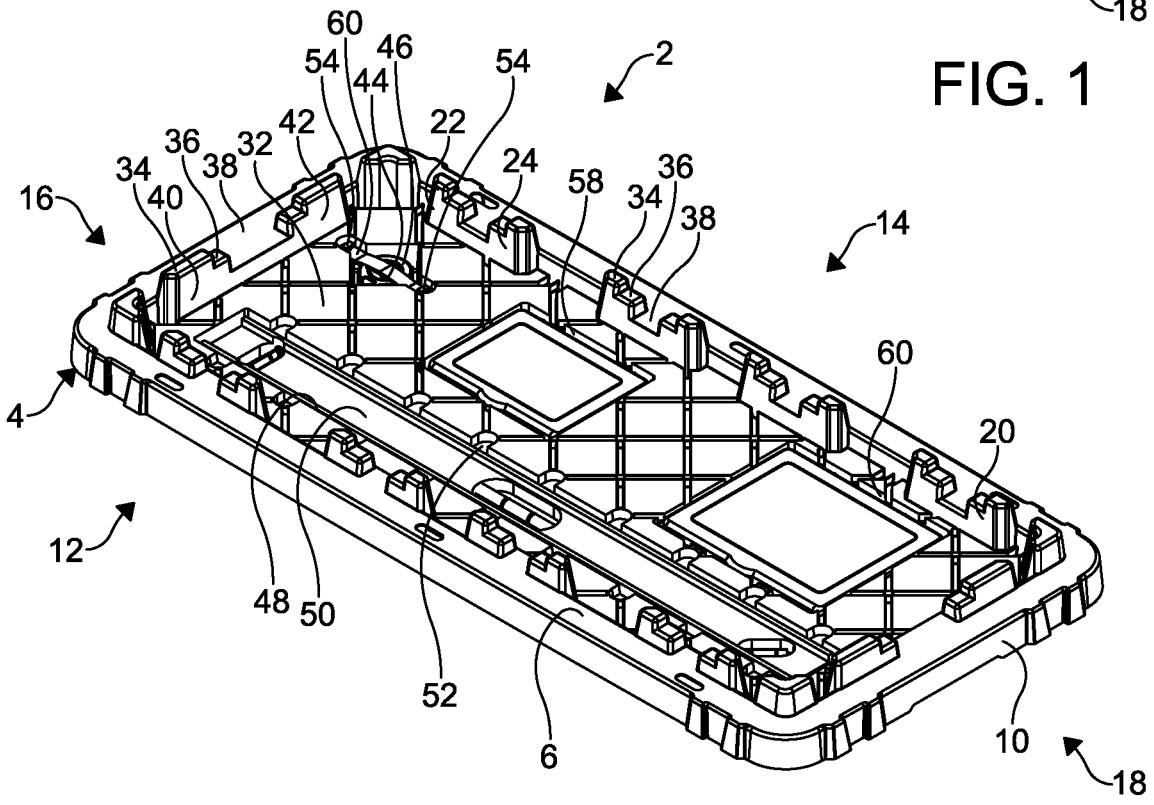
FIG. 2 is a top perspective view of the lid in FIG. 1, shown with a level and tape measure disposed recesses formed in the lid.

FIGS. 1-2 illustrate a lid 2 according to a first embodiment of the disclosure. The lid 2 has a main body 4 with a lip 6. The lid is configured to be secured with and cover a container or tote (identified as 8' in FIGS. 3-5) for storage of items. The lid 2 is further surrounded by a skirt 10, which militates against the lid 2 disconnecting from the tote 8. The lid 2 may be substantially rectangular in shape, and have a first side 12, a second side 14, a third side 16, and a fourth side 18. The first side 12 of the lid 2 is parallel to the second side 14 and the third side 16 is parallel to the fourth side 18. The lid 2 may be formed of a thermoplastic material such as polypropylene or polyethylene by an injection molding process, all as non-limiting examples. One of ordinary skill in the art may also select other suitable shapes, dimensions, materials, and manufacturing methods for the lid 2, as desired.

According to various embodiments of the present disclosure, and as shown in FIGS. 1-2, the lid 2 is configured to support cross beams or other items placed on the main body 4. Moreover, the lid 2 described herein is configured to be stackable in both a nested configuration and an unnested configuration relative to another one of the lids 2. The lid 2 of the present embodiment is also configured to support another tote 8 stacked on top of the lid 2.

With continued reference to FIGS. 1-2, the lid 2 may have a plurality of pylons 20. The pylons 20 are configured to support and stabilize a cross beam disposed between adjacent ones of the pylons 20. The pylons 20 may be oriented in pairs along the perimeter or lip 6 of the main body 4. For example, the pylons 20 may include a first pylon 22 and a second pylon 24. As shown, the first pylon 22 may be disposed adjacent to, but spaced apart from, the second pylon 24.

As illustrated in FIGS. 1-2, the first pylon 22 and the second pylon 24 may each have a plurality of platforms that are vertically spaced apart from one another on a single one of the pylons 20. The platforms on the first pylon 22 may be disposed on a same plane as corresponding platforms on the second pylon 24. It should be appreciated that this orientation and arrangement of the different platforms on the different pylons 20 defines a substantially flat surface, albeit discontinuous with a gap between the pylons 20 for some of the platforms, which is configured to support cross beams placed between the first pylon 22 and the second pylon 24.

It should be appreciated that the pylons 20 may be spaced apart from another in an arrangement configured to receive any common cross beam normally used in conjunction with a sawhorse to form a working surface. The common cross beam may be a conventional wooden board having a narrower side and a broader side as is known in the art. As non-limiting examples, the pylons 20 may be configured to receive a 2"×4" board (shown as 26' in FIG. 4), a 2"×6" board (shown as 28' in FIG. 4), or a 2"×8" board (shown as 30' in FIG. 5). Although described herein primarily with respect to support of conventional board dimensions, the pylons 20 may be horizontally spaced apart and configured to receive and support a variety of different cross beams or boards of other dimensions, as desired.

Figure 3:
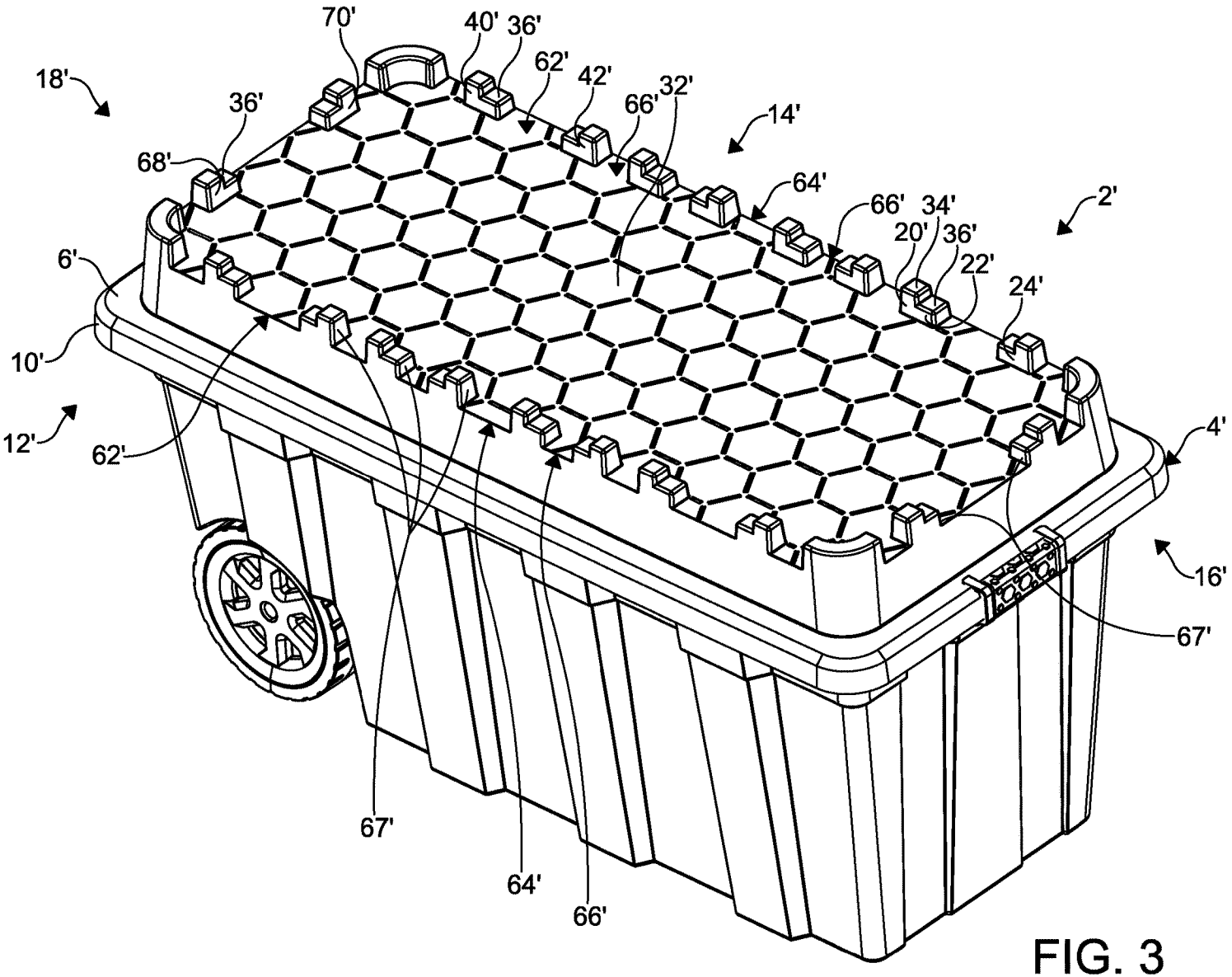
FIG. 3 is a top perspective view of a lid according to another embodiment of the present disclosure.
Figure 4:
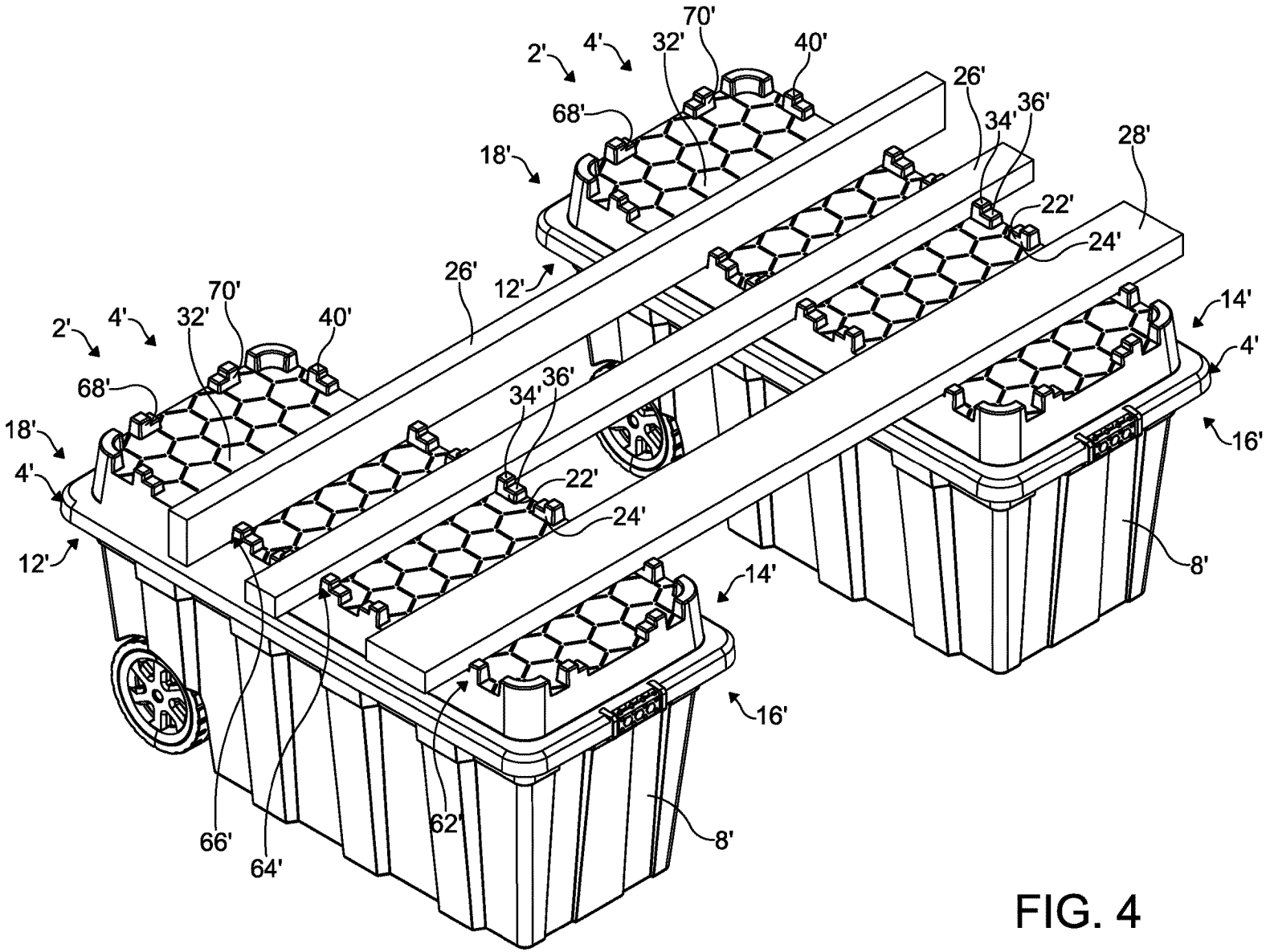
FIG. 4 is a top perspective view of a combination including a pair of lids as shown in FIG. 3, and further show disposed on a pair of totes with three boards in different orientations supported by the lids along a width of each of the totes.
Figure 5:
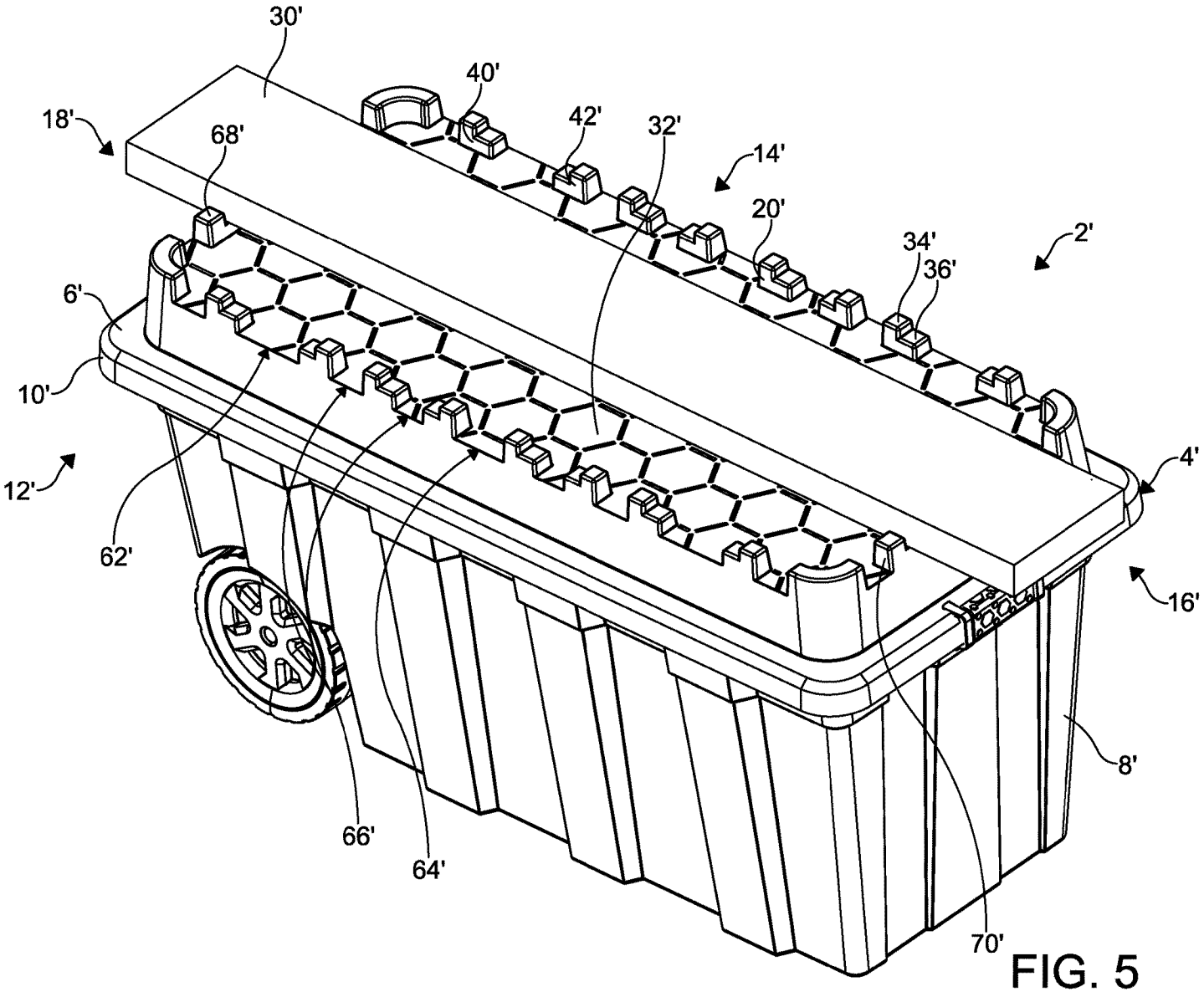
FIG. 5 is a top perspective view of the lid in FIG. 3, shown disposed on a tote and supporting a board along a length of the tote.

In one embodiment, as shown in FIGS. 1-2, the lid 2 has an upper surface 32, which is vertically and horizontally spaced apart from the lip 6 of the lid 2. When the lid 2 is disposed on the tote (for example, as shown in the embodiments of FIGS. 3-5), the upper surface 32 may be disposed below the lip 6 and an upper rim of the tote. Other positions for the upper surface 32 of the lid 2 may also be selected within the scope of the present disclosure.

As described hereinabove, the main body 4 of the lid 2 also has the plurality of pylons 20. The pylons 20 may disposed in pairs around a perimeter of the upper surface 32. One pair of pylons 20 on each side of the lid 2 may further correspond to (i.e., be placed directly across from) another pair of pylons 20 on the opposing side of the lid 2. The platforms of the pylons 20 on one side of the main body 4 may further be arranged on a same plane as the platforms of the pylons 20 on an opposite side of the main body 4. This creates two corresponding flat or planar surfaces that are on the same plane and suitable for supporting the cross beam, such as a board, which may be placed across the main body 4 of the lid 2 in a substantially level orientation.

In particular, and as depicted in FIGS. 1-2, each of the pylons 20 may have three platforms 34, 36, 38. The pylon 20 may have a first platform 34 that is horizontally spaced apart from a second platform 36, and a second platform 36 that is horizontally spaced apart from a third platform 38. The first platform 34 is also vertically spaced apart from the second platform 36, and the second platform 36 is also vertically spaced apart from the third platform 38. Although shown in FIGS. 1-2 being substantially planar and rectilinear in shape, one or ordinary skill in the art may select any other suitable surface texture and shape for the platforms 34, 36, 38, as desired.

In a most particular example, on the first side 12 and the second side 14 of the lid 2 there may be a total of four pairs of pylons 20 that are configured to support a 2"×4" board. Each pair of pylons may include the first pylon 22 and the second pylon 24, and the platforms 34, 36, 38 on the first pylon 22 are disposed on the same planes as with corresponding platforms 34, 36, 38 on the second pylon 24. The platforms 34, 36, 38 create two corresponding flat or planar surfaces that may support the 2"×4" board when placed within the pair of pylons 20. The first platform 34, or the top of the pylons 20, may have cross members such as boards rested directly thereon, although it should be appreciated that such boards would not be secured against lateral movement as with placement on the second or third platforms 36, 38. Additionally, as shown in FIGS. 1-2, the third platform 38 of each pylon may form a single flat or planar surface between each pylon pair 20, without a gap formed therebetween as with the first and second platforms 34, 36.

It should be further appreciated that the first and second pylons 22, 24 are configured to securely support the 2"×4" board placed within the pylons 20 in more than one orientation (for example, as shown in the embodiment of FIG. 4). The second platforms 36 of the first and second pylons 22, 24 are configured to support a 2"×4" board in a first orientation, where the broader side of the board is oriented parallel with the upper surface 32 of the lid 2 and abuts the second platforms 36. The third platforms 38 on the first and second pylons 22, 24 are configured to also support the 2"×4" board, but where the narrower side of the board is oriented parallel with the upper surface 32 of the lid 2 and abuts the single flat or planar surface defied by the third platforms 38.

With further reference to FIGS. 1-2, on the third side 16 and fourth side 18 of the lid 2 there may be a third pylon 40 and a fourth pylon 42 that are configured to support either a 2"×4" or a 2"×6" board. The second platform 36 on each of the third and fourth pylons 40, 42 is configured to support a 2"×6" board (for example, as also shown in the embodiment of FIG. 5), where the broader side of the board is parallel to the upper surface 32 of the lid 2 and abuts the second platforms 36. The third platform 38 on each of the third and fourth pylons 40, 42 are further configured to support a 2"×4" board, where the broader side of the board is parallel to the upper surface 32 of the lid 2 and abuts the third platforms 38.

In all cases, it should be understood that substantially vertical side walls (for example, identified as 67' in FIG. 3) of the pylons 20 connecting the various platforms 34, 36, 38 may also abut the boards when placed between the pylons 20. These substantially vertical side walls thereby further secure and support the boards in the orientation in which they have been placed by the user. In certain examples, the distances between these substantially vertical side walls may be selected so as to provide a friction-fit with the boards when inserted between the pylons 20 in an appropriate orientation associated with the gap between the vertical side walls.

With renewed reference to FIGS. 1-2, the main body 4 of the lid 2 may also have recesses 44, 46 formed therein. At least some of these recesses 44, 46 may be shaped or configured to hold specific tools. For example, the main body 4 may have a first recess 44 that is configured to hold a tape measure 46. The first recess 44 may be square or circular in shape and dimensioned appropriately in order to accommodate a conventional shape of the tape measure 46, for example. The main body 4 may have a second recess 48 that is configured to hold a level 50. The second recess 48 may be elongate and rectangular in shape and dimensioned appropriately in order to accommodate a conventional shape of the level 50. The second recess 48 is configured to hold a level 50 and may be surrounded by indents 52. The indents 52 allow a user to more easily access the level 50 in the recess 48, by facilitating an insertion of a user's fingers into the recess 48 to grip and pull the level 50 from the recess 48, as desired.

Furthermore, the tape measure 46 may be selectively secured within the recess 44 using securement means such as two rotatable clasps 54 and a strap 56, as shown in FIGS. 1-2. As one non-limiting example, the rotatable clasps 54 may be injection molded I-shaped elements that have opposing elongate heads, and which are disposed through a hole in the lids 2 and an elongate hole in the strap 56, and which can be selectively rotated in order to be pulled through the elongate hole in the strap 56 to disengage the strap 56 from the recess 44. However, the tape measure 46 may be secured to the lid 2 using any other suitable method chosen by a skilled artisan, within the scope of the present disclosure.

Additionally, in certain embodiments, the main body 4 of the lid 2 may also have at least one of a third recess 58 and a fourth recess 60 formed therein. The third recess 58 and the fourth recess 60 may be configured to receive tool boxes, or storage containers with multiple compartments, such as the SORTMASTER® tool or small parts organizer, commercially available from Stanley Black & Decker, Inc., located in New Britain, Conn. Other shapes for the third and fourth recesses 58, 60 may also be employed, as desired.

In operation, the lid 2 is secured to the tote when it is disposed on a top of the tote. When disposed on the top of the tote, the outer lip 6 may envelope the perimeter of the tote. The tote is then transported to a construction site and used to house or store tools, as well as aid in the cutting and alteration of work product. For example, a user may obtain boards, and place the boards in between adjacent pylons 20 of the lid 2, in order to stabilize the boards. A work surface or other support structure for work product, tools, and other work materials may be formed by the boards or further materials (e.g., plywood sheets) disposed atop the boards. Additionally, in operation, the recesses 46, 48, 58, 60 in the main body 4 of the lid 2 allow the user to quickly access a variety of tools. For example, when desired, a user can unlock the securement means 54, 60 to retrieve the tape measure 46, or to remove the level 50 from the recess 48.

In a further embodiment, the lid 2' is described with reference to FIGS. 3-5. In FIGS. 3-5, like or related structure to that shown in FIGS. 1-2 is identified with the same reference number and a prime symbol (') for purpose of clarity.

As shown in FIG. 3, the lid 2' has an upper surface 32' that is horizontally and vertically spaced apart from the lip 6'. The upper surface 32' is oriented above the lip 6' when the lid 2' is disposed on the tote 8'. A plurality of pylons 20' surrounds the outer perimeter of the upper surface 32'. The pair of pylons 20' on each side of the lid 2' correspond to a pair of pylons 20' on the opposing side of the lid 2'. In other words, the platforms of the pylons 20' on each side of the main body 4' are oriented on a same plane as the corresponding platforms of the pylons 20' on the opposing side of the main body 4'. This creates two flat or planar surfaces that are configured to support the cross beam, such as a board, which may be placed across the main body 4' of the lid 2' in a substantially level orientation.

As shown in FIGS. 3-5, the spaced apart arrangement of adjacent pylons 20' may further result in the formation of spaces or areas 62', 64', 66' of the upper surface 32' that are configured to receive boards of desired dimensions, as described further hereinbelow. Both the placement and the size of the pylons 20' may be preselected by a skilled artisan to define the areas 62', 64', 66' to be suitable the desired end use.

In a particular embodiment, each of the pylons 20' may have two platforms 34', 36'. The pylon 20' may have a first platform 34' that is horizontally spaced apart from a second platform 36'. The first platform 34' may also be vertically spaced apart from the second platform 36'. It should be appreciated that the pylons 20' shown in FIGS. 3-5 do not have a third platform spaced apart from the upper surface 32' of the lid 2' (for example, identified as 38 in the embodiment of FIGS. 1-2). Instead, the area between a base of the spaced apart but adjacent pylons 20' defines a location on the upper surface 32' of the lid 2' that is configured to support a variety of construction materials, such as the boards shown in FIGS. 4-5.

Referring now to FIGS. 4-5, the pylons 20' may be configured to support a 2"×4" board (identified by 26'), a 2"×6" board (identified by 28'), or a 2"×8" board (identified by 30'). For example, on the first side 12' and the second side 14' of the lid 2' there may be the first pylon 22' and the second pylon 24'. The first and second pylons 22', 24' on each side 12', 14' are spaced apart from one another and configured to support a 2"×4" board 26'. Likewise, the third pylon 40' and the fourth pylon 42' on each side 16', 18' are each spaced apart from one another and configured to support a 2"×6" board 28'.

In particular, the second platforms 36' of the first pylon 22' and the second pylon 24' may be configured to support the 2"×4" board 26', where the broad side of the board is oriented parallel with the upper surface 32' of the lid 2' and abutting the second platforms 36'. The upper surface 32' of the lid 2' disposed between the bases of the first pylon 22' and second pylon 24' defines an area also configured to support a 2"×4" board 26', where the narrower side of the board is oriented parallel with the upper surface 32' of the lid 2' and abutting the upper surface 32' of the lid 2' between the first and second pylons 22', 24'.

The third pylon 40' and fourth pylons 42' on the first side 12' and second side 14' are configured to support a 2"×6" board 28' and 2"×4" board 26'. The second platform 36' on the third pylon 40' and the fourth pylon 42' may be configured to support a 2"×6" board 28', where the broader side is parallel to the upper surface 32' and abutting the platforms 36'. The upper surface 32' of the lid 2', defined by an area between the bases of the third pylon 40' and fourth pylon 42', is configured to support a 2"×4" board 26', where the broader side is parallel to the upper surface 32' of the lid 2'.

In a further embodiment, there may also be a first space configured to receive the broader side of the board parallel to the upper surface 32' of the lid 2', or there may be a second space configured to receive the narrower side of the board parallel to the upper surface 32' of the lid 2', between adjacent pylons 20'.

With renewed reference to FIGS. 3 and 5, the third side 16' and fourth side 18' of the lid 2' may also be configured to support a 2"×8" board 30' or a 2"×6" board 28. For example, the third side 16' may have a fifth pylon 68' and sixth pylon 70'. The fifth pylon 68' and the sixth pylon 70' may each have the second platform 36', and together may be configured to support a 2"×8" board 30', where the broader side of the board is parallel to the upper surface 32' of the lid 2' and abutting the second platforms 36'. The upper surface 32' of the lid 2' disposed between the bases of the fifth pylon 68' and sixth pylon 70' may also be configured to support a 2"×6" board 28', where the broader side of the board is parallel to the upper surface 32' of the lid 2' and abutting the upper surface 32' of the lid 2'.

In all cases, it should be understood that the substantially vertical walls 67' of the pylons 20' connecting the various platforms 34', 36' may also abut the boards when placed between the pylons 20'. These substantially vertical walls 67' thereby further secure and support the boards in the orientation in which they have been placed by the user. In certain examples, the distances between these substantially vertical walls 67' of adjacent ones of the pylons 20' are selected so as to provide a friction-fit with the boards when inserted between the pylons 20' in an appropriate orientation associated with the gap between the vertical walls 67'.

In operation, as shown in FIG. 4, two or more of the totes 8' with the lids 2' may be disposed adjacent to one another to stabilize a plurality of the boards, of the same or different dimensions, or other items for construction purposes. Where multiple boards are used, a sheet or work layer, such as a plywood sheet (not shown), may be placed atop the boards to provide a work surface between the lids 2'. Furthermore, the boards may be placed across the first side 12' and second side 14' of the lid 2' on opposing totes 8' as shown in FIG. 4, or be placed across the third side 16' and fourth side 18' of the lid 2' of a single tote 8', as shown in FIG. 5. Other arrangements and orientations of the totes 8', the boards, and the pylons 20' configured to receive the same, are also contemplated and considered to be within the scope of the present disclosure.

In a further embodiment, the lid 2" is described with reference to FIGS. 6-8. In FIGS. 6-8, like or related structure to that shown in FIGS. 1-5 is identified with the same reference number and a double-prime symbol (") for purpose of clarity.

As shown in FIG. 6, the lid 2" is configured to connect with a container or tote (for example, as identified by 8' in FIGS. 3-5). The lid 2" has an upper surface 32" that is horizontally and vertically spaced apart from the lip 6" of the lid 2". The upper surface 32" is disposed above the lip 6" of the lid 2" when the lid 2" is attached to the tote, for example. Surrounding the outer perimeter of the upper surface 32" are also a plurality of the pylons 20".

In the embodiment shown in FIGS. 6-8, each of the pylons 20" is singular or unitary in shape, and not stepped or provided with discrete platforms as in the embodiments shown in FIGS. 1-5. The pylons 20" enable one tote with a lid 2" to be stacked a top another tote. The pylons 20" stabilize a tote, militating against a tote from sliding off when stacked onto another tote with the lid 2". Moreover, the pylons 20" also may be used to secure boards across the same lid 2", or two or more lids 2" on spaced apart totes, in order to provide a work surface as described hereinabove with respect to FIGS. 1-5.

With renewed reference to FIGS. 6-8, the main body 4" of the lid 2" may also have a recess 74" that is configured to receive tool boxes, or container boxes with multiple compartments, such as the SORTMASTER® tool or small parts organizer, commercially available from Stanley Black & Decker, Inc., located in New Britain, Conn.

In particular embodiments, the recess 74" has side walls 76" and a bottom surface 78". The lids 2" with the recess 74" may also be stackable together, in two different configurations for further storage options. For example, in an unnested configuration shown in FIG. 7, the recess 74" of each lid 2" is spaced apart horizontally from the other so that the bottom wall 78" of the topmost lid 2" rests upon the upper surface 32" of the bottommost lid 2". In another example, in a nested configuration shown in FIG. 8, the recess 74" of the topmost lid 2" is disposed within the recess 74" of the bottommost lid 2". In both configurations, it should be appreciated that an open volume or space remains between the bottom walls 78" of the respective stack lids 2", such that the two lids 2" can be used together as a further storage option by the end user. However, in the nested configuration, this open volume or space will be less than that available in the unnested configuration, which may be especially suitable for storage of the lids 2" and their contents.

It should be further understood that the side walls 76 of the recess 74 may be shorter than the distance from the lip 6" of the lid 2" to the upper surface 32" of the lid 2". This results in the lid 2" that can be stacked and secured even when the bottom wall 78" of the recess 74" is disposed on the upper surface 32" of the adjacent lid 2".

In particular examples, the sidewalls 76" are also angled relative to a vertical plane, as shown in FIGS. 7-8. The angling of the sidewalls 76" in this manner permits for an easier stacking and nesting of the lids 2" in the nested configuration. When the bottom surface 78" of the recess 74" rests on the upper surface 32" of the adjacent lid 2", the lip 6" of the lid 2" envelopes the upper surface 32" of the adjacent lid 2", enabling the two lids 2" to be conveniently stacked.

Advantageously, the lid 2, 2', 2" of the present disclosure has been found to be suitable for supporting construction materials and implements, and can serve as an alternative to sawhorses. The lid 2, 2', 2" furthermore can provide access to tools without requiring removal of the lid 2, 2', 2" from the associated container while being used in this manner.

While certain representative embodiments and details have been shown for purposes of illustrating the invention, it will be apparent to those skilled in the art that various changes may be made without departing from the scope of the disclosure, which is further described in the following appended claims.

What is claimed is:

1. A lid for a tote, comprising:

a main body having an upper surface and a lip surrounding a perimeter of the upper surface, wherein the main body has a first side and a second side, the first side being parallel to the second side; and a plurality of pylons, wherein the plurality of pylons includes a first set of pylons and a second set of pylons disposed on the main body and arranged around the perimeter of the upper surface, wherein each of the first set of pylons and the second set of pylons includes a first pylon and second pylon, wherein each of the first pylon and the second pylon is stepped in shape and includes a first platform, a second platform and a third platform, the first platform horizontally spaced apart from the second platform, and the second platform horizontally spaced apart from the third platform, and the first platform vertically spaced apart from the second platform, and the second platform vertically spaced apart from the third platform, wherein the second platform is disposed horizontally and vertically between the first platform and the third platform, wherein each of the first platform, the second platform, and the third platform on the first pylon is disposed on a same plane as a corresponding one of the first platform, the second platform, and the third platform on the second pylon, and the third platform is coplanar with the upper surface of the main body, and wherein the first set of pylons is disposed adjacent the first side of the main body, and the second set of pylons is disposed adjacent the second side of the main body, the first set of pylons horizontally spaced apart from the second set of pylons but connected to the second set of pylons by the upper surface of the main body, whereby the first set of pylons and the second set of pylons are configured to receive, support, and stabilize a cross beam placed therebetween.

2. The lid of claim 1, wherein the main body has a third side and a fourth side, the third side being parallel to the fourth side.

3. The lid of claim 2, wherein the cross beam is a board selected from the group consisting of 2"×4" boards, 2"×6" boards, and 2"×8" boards.

4. The lid of claim 3, wherein the second platforms on the first pylon and the second pylon are configured to receive and abut a broader side of the board.

5. The lid of claim 3, wherein the third platforms on the first pylon and the second pylon are configured to receive and abut a narrower side of the board.

6. The lid of claim 3, wherein an area defined as a portion of the upper surface disposed between bases of the first set of pylons and the second set of pylons is configured to receive one of a narrower side of the board and a broader side of the board.

7. The lid of claim 2, wherein the plurality of pylons includes a third set of pylons and a fourth set of pylons, the third set of pylons and the fourth set of pylons are horizontally spaced apart from one another and the third set of pylons is disposed on the third side and the fourth set of pylons is disposed on the fourth side of the main body.

8. The lid of claim 1, wherein the main body has a first recess formed in the upper surface thereof, the first recess configured to receive a tape measure.

9. The lid of claim 8, wherein the first recess is one of square and circular in shape.

10. The lid of claim 1, wherein the main body has a second recess formed in the upper surface thereof, the second recess configured to receive a level.

11. The lid of claim 10, wherein the second recess is elongate and rectangular in shape.

12. The lid of claim 1, wherein the main body has a third recess formed in the upper surface thereof, the third recess configured to receive a tool box.

13. The lid of claim 12, wherein the third recess has sidewalls and a base wall, the sidewalls connecting the upper surface to the base wall, and the sidewalls being angled relative to vertical.

14. The lid of claim 13, wherein the main body further includes a skirt disposed adjacent the lip and circumscribing the main body, wherein the base wall is arranged on a plane that is beneath a plane on which the bottommost edge of the skirt is disposed.

15. A combination, comprising:

a first tote having a hollow main body and an upper free edge, wherein the hollow main body has a first side and a second side; and a first lid for the first tote, the first lid including a main body having an upper surface and a lip surrounding a perimeter of the upper surface, and a plurality of pylons, wherein the plurality of pylons includes a first set of pylons and a second set of pylons disposed on the main body and arranged around the perimeter of the upper surface, wherein each of the first set of pylons and the second set of pylons includes a first pylon and second pylon, wherein each of the first pylon and the second pylon is stepped in shape and includes a first platform, a second platform and a third platform, the first platform horizontally spaced apart from the second platform, and the second platform horizontally spaced apart from the third platform, and the first platform vertically spaced apart from the second platform, and the second platform vertically spaced apart from the third platform, wherein the second platform is disposed horizontally and vertically between the first platform and the third platform, and wherein each of the first platform, the second platform, and the third platform on the first pylon is disposed on a same plane as a corresponding one of the first platform, the second platform, and the third platform on the second pylon, and the third platform is coplanar with the upper surface of the main body, wherein the first set of pylons is disposed adjacent the first side of the main body, and the second set of pylons is disposed adjacent the second side of the main body, the first set of pylons spaced apart from the second set of pylons but connected to the second set of pylons by the upper surface of the main body, whereby the first set of pylons and the second set of pylons are configured to receive, support, and stabilize a cross beam placed therebetween, wherein the first lid is disposed on the upper free edge of the first tote, and wherein the first cross beam is a board selected from the group consisting of 2"×4" boards, 2"×6" boards, and 2"×8" boards.

16. The combination of claim 15, further comprising:

a second tote having a hollow main body and an upper free edge, wherein the hollow main body has a first side and a second side;

a second lid for the second tote, the second lid including a main body having an upper surface and a lip surrounding a perimeter of the upper surface, and a plurality of pylons, wherein the plurality of pylons includes a first set of pylons and a second set of pylons disposed on the main body and arranged around the perimeter of the upper surface, wherein each of the first set of pylons and the second set of pylons includes a first pylon and second pylon, wherein each of the first pylon and the second pylon is stepped in shape and includes a first platform, a second platform and a third platform, the first platform horizontally spaced apart from the second platform, and the second platform horizontally spaced apart from the third platform, and the first platform vertically spaced apart from the second platform, and the second platform vertically spaced apart from the third platform, wherein the second platform is disposed horizontally and vertically between the first platform and the third platform, and wherein each of the first platform, the second platform, and the third platform on the first pylon is disposed on a same plane as a corresponding one of the first platform, the second platform, and the third platform on the second pylon, and the third platform is coplanar with the upper surface of the main body, wherein the first set of pylons is disposed adjacent the first side of the main body, and the second set of pylons is disposed adjacent the second side of the main body, the first set of pylons spaced apart from the second set of pylons but connected to the second set of pylons by the upper surface of the main body, whereby the first set of pylons and the second set of pylons are configured to receive, support, and stabilize the cross beam placed therebetween; and the cross beam disposed across the first lid and the second lid, wherein the first set of pylons of the first lid, the second set of pylons of the first lid, the first set of pylons of the second lid, and the second set of pylons of the second lid receive, support, and stabilize the cross beam placed therebetween, wherein the second lid is disposed on the upper free edge of the second tote.

17. The combination of claim 16, further comprising a plywood sheet disposed on the board to form a working surface disposed between the first tote and the second tote.

18. A combination, comprising:

a first lid including a main body having an upper surface and a lip surrounding a perimeter of the upper surface, and a plurality of pylons, wherein the plurality of pylons has a first set of pylons and a second set of pylons disposed on the main body and arranged around the perimeter of the upper surface, wherein the main body includes a first side and a second side; and a second lid including a main body having an upper surface and a lip surrounding a perimeter of the upper surface, wherein the main body includes a first side and a second side, and a plurality of pylons, wherein the plurality of pylons includes a first set of pylons and a second set of pylons disposed on the main body and arranged around the perimeter of the upper surface, wherein the first set of pylons and the second set of pylons of each of the first lid and second lid includes a first pylon and second pylon, wherein each of the first pylon and the second pylon is stepped in shape and includes a first platform, a second platform and a third platform, the first platform horizontally spaced apart from the second platform, and the second platform horizontally spaced apart from the third platform, and the first platform vertically spaced apart from the second platform, and the second platform vertically spaced apart from the third platform, wherein the second platform is disposed horizontally and vertically between the first platform and the third platform, and wherein each of the first platform, the second platform, and the third platform on the first pylon is disposed on a same plane as a corresponding one of the first platform, the second platform, wherein the first set of pylons is disposed adjacent the first side of the main body, and the second set of pylons is disposed adjacent the second side of the main body, the first set of pylons spaced apart from the second set of pylons but connected to the second set of pylons by the upper surface of the main body, whereby the first set of pylons and the second set of pylons are configured to receive, support, and stabilize a cross beam placed therebetween, wherein the first lid is disposed atop the second lid in one of a nested configuration and an unnested configuration.

19. The combination of claim 18, wherein each of the first lid and the second lid have a recess formed in the upper surface thereof, and in the nested configuration the recesses are aligned and in the unnested configuration the recesses are not aligned.

* * * * *